US005232740A

United States Patent [19]

Von Hagen et al.

[11] Patent Number: 5,232,740

[45] Date of Patent: Aug. 3, 1993

[54] METHOD OF MANUFACTURING PLATED HOLLOW BLOCKS

[75] Inventors: Ingo Von Hagen, Krefeld; Christoph Prasser, Essen; Fritz P. Pleschiutschnigg, Duisburg; Lothar Parschat, Ratingen, all of Fed. Rep. of Germany

[73] Assignee: Mannesmannufer Aktiengesellschaft, Dusseldorf, Fed. Rep. of Germany

[21] Appl. No.: 776,306

[22] PCT Filed: May 8, 1990

[86] PCT No.: PCT/DE90/00335

§ 371 Date: Nov. 13, 1991

§ 102(e) Date: Nov. 13, 1991

[87] PCT Pub. No.: WO90/14446

PCT Pub. Date: Nov. 29, 1990

[30] Foreign Application Priority Data

May 16, 1989 [DE] Fed. Rep. of Germany ..... 3916114

[51] Int. Cl.[5] ..... B05D 7/22

[52] U.S. Cl. ..... 427/239; 164/464; 427/329; 427/431; 427/436

[58] Field of Search ..... 164/66.1, 94, 116, 464, 164/DIG. 6; 427/234, 239, 435, 436, 329, 431

[56] References Cited

U.S. PATENT DOCUMENTS

| | | | |
|---|---|---|---|
| 1,938,257 | 12/1933 | Jones | 22/200 |
| 3,743,005 | 7/1973 | Veitl et al. | 164/94·X |
| 4,523,622 | 6/1985 | Faste et al. | 164/66.1 |

FOREIGN PATENT DOCUMENTS

| | | |
|---|---|---|
| 246040 | 11/1987 | European Pat. Off. . |
| 54-141343 | 11/1979 | Japan . |
| 58-103937 | 6/1983 | Japan . |
| 60-21174 | 2/1985 | Japan . |
| 61-3874 | 1/1986 | Japan . |
| 61-52357 | 3/1986 | Japan . |
| 1-218759 | 8/1989 | Japan . |

*Primary Examiner*—Michael Lusigan

*Attorney, Agent, or Firm*—Cohen, Pontani, Lieberman, Pavane

[57] ABSTRACT

A method of manufacturing plated hollow metallic blocks for further processing into seamless tubes of the type in which a body is immersed one or more times into a melt includes: protecting the inner surfaces of a hollow body of plating material against the admission of a melt of support material during the immersion of the hollow body in the melt of support material; immersing such hollow body formed of plating material into the melt of support material; removing the hollow body from the melt of support material; and crystallizing a layer of support material on the outer surface of the hollow body.

12 Claims, No Drawings

METHOD OF MANUFACTURING PLATED HOLLOW BLOCKS

FIELD OF THE INVENTION

The present invention relates to a method of manufacturing plated hollow blocks which can be further processed by hot or cold working into seamless metal tubes, such as steel tubes, which are plated at the inside thereof.

BACKGROUND OF THE INVENTION

The manufacture of internally plated seamless steel tubes has up to now been generally performed in the manner that a hollow block formed of a support material and a plating material is shaped by extrusion so as to form a tube. Initially, a cylindrical block of a support material such as low-alloy steel is drilled in an axial direction so as to create a hollow block. A cylindrical block of a plating material such as high alloy steel and of the same length and of a diameter corresponding to the inside diameter of the hollow block formed of the support material is also drilled in the axial direction and inserted into the hollow block of said support material.

The two hollow blocks are placed one within the other and are welded together at their ends so that the annular slot between the two hollow blocks is tightly closed off so that the contact surfaces of the hollow blocks do not oxidize upon heating to the extrusion temperature and prevent a suitable bond between the support material and the plating material.

However, this procedure has serious disadvantages. The weld on the ends represents a weak point which can tear, for instance, upon heating so that the contact surfaces may nevertheless oxidize. In addition, the preparation of a plated hollow block which is ready for use requires considerable expense on the one hand, due to the working (i.e., drilling, welding) necessary and, on the other hand, the considerable use of expensive plating material (i.e., waste produced upon the drilling).

For the manufacture of a steel plate which is plated on one side, the applicant has already proposed a method (Federal Republic of Germany P 39 07 903) in which the plating material is applied in molten state to a support plate. For this purpose, the flat sides of two support plates are placed tightly on one another and dipped into a melt of the plating material until a sufficiently thick layer of plating has formed by crystallization.

However, this procedure of applying a layer of plating directly from the molten state onto the support material cannot be directly applied to the manufacture of plated hollow blocks. Upon the immersion of a hollow block of the support material into a melt of the plating material, a plating layer would immediately form on the inner surface as well as the outer surface. This outer layer is not necessary and would greatly increase the cost of manufacture due to the unnecessary consumption of plating material. In order to avoid outside plating, it is possible to fill a hollow block of support material with a melt of the plating material or, in order to keep the consumption of plating material as small as possible, centrifuge it, for instance, with a layer of this material and allow it to solidify. In such a case, however, the problem arises that due to different thermal expansion and shrinkage, the plating layer detaches itself from the support material before the further processing of the plated hollow block can take place.

SUMMARY OF THE INVENTION

The object of the present invention, therefore, is to provide a method by which it is possible to produce a hollow block which is plated on the inside and which avoids the disadvantages indicated.

The object of the present invention is achieved by a method wherein the inner surface of a hollow body is protected against the admission of a melt of support material. The hollow body is composed of a plating material and is dipped into a melt of support material and then removed from the melt of support material so as to crystallize a support layer on the outer surface of the hollow body.

The solution in accordance with the invention contemplates that the molten support material be applied to the outside of the solid plating material. In this way, assurance is had from the very start that the inner layer of plating cannot detach itself from the outer layer as a result of thermal shrinkage since the outer layer in any event tends towards greater shrinkage as a result of its higher initial temperature so as to remain on the plating layer. The cylindrical hollow body used for the crystallization of the layer of the support material can be produced, for example, by the hot working of a corresponding block in a punch press and insofar as necessary, machined mechanically on the inside and outside before it is immersed into the melt of support material in order to obtain clean and smooth surfaces.

Thus, it is possible to manufacture a cylindrical hollow body which is free of or requires little if any machining, and results in minimal waste of plating material. The sealing of the inner surface of this hollow body during the immersion in the molten support material can be achieved, for example, by a closure cover. However, it is preferred that a cylindrical core be used for this purpose which rests tightly against the inner surface of the hollow body. It is particularly advantageous if the core used in sealing the surface of the hollow body, is already used in producing the cylindrical hollow body by dipping the core into a melt of the plating material and allowing the required layer of plating material to crystallize thereon. For this purpose, the core must consist of a sufficiently heat-resistant material, for instance a structural steel. Its heat resistance need merely permit the core to be dipped for the required time into the melt without itself melting. For this purpose, it is advisable to provide the core with internal cooling, for example, by conducting a coolant through it. For easy removal of the core from the hollow body or block to be possible, the core must be provided on its outer surface with a parting or separating layer which is effective with respect to the melt. In the case of a steel core, a layer of rust or scale is, for instance, suitable for this purpose. This prevents direct connection between the plating material and the material of the core and makes it possible to withdraw the core from the hollow body.

The required dwell time of the steel core in the molten plating material depends upon whether a separate internal cooling of the core has been provided and upon the heat absorption capacity of the core. In order to crystallize thicker layers, the step of dipping the melt can be performed in partial steps, in which case an intermediate cooling step is performed before the next dip occurs in the melt. This procedure can be used both for the production of the plating layer and for the production of the support layer.

If the surfaces which are produced by the crystallizing of the plating material and/or of the support material are too irregular, smoothing of the surfaces can be performed, at minimal expense, by rolling while the material is still in the hot state. If the manufacture of the hollow body consisting of the plating material has been performed by dipping a core of heat-resistant material, having a parting layer on its surface, into a melt and then removing it from the melt so as to crystallize a layer of plating material on the surface of the core, then a mechanical machining so as to obtain a clean and smooth inner surface, is preferably performed before processing the hollow block into a seamless tube. In this case, only a small amount of waste material is produced. Further processing can be performed, for example, by extrusion while in the hot state or else by hot or cold pilger processing. The method of the invention is, in particular, suitable for steel materials, but it can also be used for other types of metallic materials.

DETAILED DESCRIPTION OF THE INVENTION

The invention will now be described in further detail with reference to the following two examples for the manufacture of seamless, internally plated steel tubes of St37.

A tube of a length of about 1 meter, outside diameter 120 mm and 30 mm wall thickness, of plating material 1.4301 (X5 CrNi 18 9) closed by a cover was dipped for about 25 seconds into a melt of steel of the grade St37, heated about 20° K. above liquidus temperature and then removed for intermediate cooling to about room temperature. During the time of immersion a layer of St37 of a thickness of about 22 mm crystallized on the outside of the tube. This immersion process, followed by intermediate cooling, was repeated two more times until obtaining a hollow block of a total outside diameter of 252 mm. The outer surface of the hollow block was then smoothed in hot condition by sizing rolling.

The immersion time selected for the production of the hollow block was selected so as to permit the greatest possible rate of growth of the support material St37 and, to permit an excellent connection between the plating layer and the support material. The hollow block produced was then extruded in a known manner while hot in an extruder to form a seamless steel tube of a length of about 21 meters, an outside diameter of about 80 mm, and a wall thickness of about 10 mm. The plating layer had a thickness of about 2 mm and was flawlessly attached to the support material.

In a second example, a hollow block of about 250 mm outside diameter, 60 mm inside diameter, a thickness of the plating layer of about 25 mm, and a length of about 1 meter was produced and shaped into a seamless tube. For this purpose, a bar of St37, of an outside diameter of about 60 mm, which was covered with a layer of scale was dipped into a melt of plating material 1.4301 and heated to about 30° K. above liquidus temperature. After an initial immersion time of about 35 seconds, during which a plating layer of about 17 mm had formed on the surface, the bar was removed from the melt. After an intermediate cooling to about room temperature, it was again dipped into the melt of plating material in order to obtain a total thickness of the plating layer of about 25 mm. To accomplish this, the immersion time was increased to about 47 seconds, i.e. one waited until the second plating layer which had grown and had reached its maximum in about 35 seconds, had partially melted off again. An immersion time of less than 35 seconds to obtain the 8 mm still missing from the desired thickness of the layer would have been unsuitable since the adherence to the first plating layer would then have been insufficient. After intermediate cooling, the bar provided with a plating layer of a thickness of 25 mm was then dipped in accordance with the first embodiment into a melt of St37 and heated to about 20° K. above liquidus temperature.

After three dippings and intermediate coolings, a block of an outside diameter of 236 mm had formed. In order to reach the desired outside diameter of 250 mm, a final dip of a duration of 53 seconds was then performed. Upon removal from the melt and complete solidification of the outer surface, the rod of St37 used as immersion core was pulled out of the hollow block on a removal device. Because of the layer of scale acting as parting or separating layer on the rod, this separation could be achieved without difficulty. The outer surface of the block was then smoothed while still hot. The inner surface (plating layer) of the hollow block was also subjected to a smoothing and cleaning operation in order to eliminate the irregularities caused by the layer of scale. The block was then again shaped hot in an extruder to form a seamless tube. With an outside diameter of 80 mm and an inside diameter of 30 mm, there was obtained a tube length of more than 20 meters with a thickness of the plating layer of 1.6 mm. The attachment between the two layers was again flawless.

It should be understood that the preferred embodiments and examples described are for illustrative purposes only and are not to be construed as limiting the scope of the present invention which is properly delineated only in the appended claims.

We claim:

1. A method of manufacturing an internally plated hollow metallic block of the type which can be further processed into an internally plated seamless steel tube, comprising:
   (a) forming a cylindrical hollow body of plating material, said hollow body having a bore and in inner and outer surface;
   (b) protecting said inner surface of said hollow body against the admission of melted material;
   (c) immersing said hollow body formed of plating material into a melt of support material; and
   (d) removing said hollow body from said melt of support material after a layer of support material has crystallized on the hollow body of plating material.

2. The method according to claim 1, wherein the step of protecting said inner surface of said hollow body includes inserting a core in said bore of said hollow body so as to rest tightly against said inner surface of said hollow body and further comprising the step of removing the core from said hollow body after said layer of support material has crystallized on the hollow body.

3. The method according to claim 2, wherein said hollow body of plating material is formed by:
   (a) immersing a core, having an outer surface, being composed of heat-resistant material and having a parting layer on said outer surface, into a melt of said plating material;

(b) removing said core from said melt of plating material after a layer of plating material has crystallized on the core; and (c) removing said core from said hollow body of plating material.

4. The method according to claim 2, wherein said crystallization of said support material is performed in at least two steps by removing said hollow body from said melt of support material after a period of immersion within said melt of support material; and by subjecting the hollow body to an intermediate cooling period before again immersing said hollow body in said melt of support material so as to permit further growth of the crystallized layer of support material.

5. The method according to claim 3, wherein said crystallization of said plating material is performed in at least two steps by removing said core from said melt of plating material after a period of immersion within said melt of plating material; and by subjecting said core to an intermediate cooling period before again immersing said core in said melt of plating material so as to permit further growth of the crystallized layer of plating material.

6. The method according to claim 1, further comprising the step of smoothing said surface of plating material prior to immersing said body into said melt of said support material.

7. The method according to claim 1, further comprising the step of smoothing the outer surface of said support material before said hollow block undergoes further processing.

8. The method according to claim 6, wherein said step of smoothing is performed by a smoothing roll.

9. The method according to claim 7, wherein said step of smoothing is performed by a smoothing roll.

10. The method according to claim 3, further comprising the step of cooling the inside of said core by a stream of coolant during the immersion of said core into said melt of plating material.

11. The method according to claim 3, further comprising the step of cooling the inside of said core by a stream of coolant during the immersion of said core and said hollow body into said melt of support material.

12. The method according to claim 3, further comprising the steps of cleaning said inner surface of the hollow block after removing said core from said hollow block; and smoothing said inner surface of said block before further shaping is performed on said block.

* * * * *